US007250916B2

(12) United States Patent
Kunysz et al.

(10) Patent No.: US 7,250,916 B2
(45) Date of Patent: Jul. 31, 2007

(54) LEAKY WAVE ANTENNA WITH RADIATING STRUCTURE INCLUDING FRACTAL LOOPS

(75) Inventors: Waldemar Kunysz, Calgary (CA); Earl Badger, Calgary (CA); David Plamondon, Calgary (CA)

(73) Assignee: Novatel Inc., Alberta (CA)

( * ) Notice: Subject to any disclaimer, the term of this patent is extended or adjusted under 35 U.S.C. 154(b) by 0 days.

(21) Appl. No.: 11/184,676

(22) Filed: Jul. 19, 2005

(65) Prior Publication Data

US 2007/0018899 A1 Jan. 25, 2007

(51) Int. Cl.
*H01Q 13/10* (2006.01)
*H01Q 1/38* (2006.01)
*H01Q 1/36* (2006.01)

(52) U.S. Cl. ..... 343/770; 343/700 MS; 343/895

(58) Field of Classification Search ..... 343/700 MS, 343/767, 770, 895
See application file for complete search history.

(56) References Cited

U.S. PATENT DOCUMENTS 5,621,422 A * 4/1997 Wang ..... 343/895
6,445,354 B1 9/2002 Kunysz
6,452,560 B2 9/2002 Kunysz
6,466,177 B1 * 10/2002 Kunysz ..... 343/769
6,480,162 B2 11/2002 Sabet et al.
6,642,898 B2 * 11/2003 Eason ..... 343/770
2002/0067315 A1 6/2002 Kunysz et al.

OTHER PUBLICATIONS

Nurnberger, M. W., et al., "A Planar Slot Spiral for Multi-Function Communications Apertures", Radiation Laboratory, Department of Electrical Engineering and Computer Science, University of Michigan, IEEE, 1998, pp. 774-777.
Nurnberger, M. W., et al., "New Techniques for Extremely Broadband Planar Slot Spiral Antennas", Radiation Laboratory, Department of Electrical Engineering and Computer Science, University of Michigan, IEEE, 1999, pp. 2690-2693.
Andersen, Lars and Volakis, John L., "Simulation of Linearly Tapered Slot Antennas Using an Adaptive Multi-Resolution FE/BI Approach", Radiation Laboratory, Department of Electrical Engineering and Computer Science, University of Michigan, IEEE, 2000, pp. 1180-1183.
Notification of Transmittal of the International Search Report and the Written Opinion of the International Searching Authority, or the Declaration. PCT/CA2006/001127. Nov. 2, 2006.

* cited by examiner

*Primary Examiner*—Shih-Chao Chen
(74) *Attorney, Agent, or Firm*—Cesari & McKenna, LLP

(57) ABSTRACT

An antenna is provided for acquiring RF signals from various satellite ranging systems including GPS, GLONASS, GALILEO and OmniSTAR®. The antenna configuration includes a radiating structure of multi-arm spiral slots terminated with fractal loops. A leaky wave microstrip spiral feed network is used to excite the radiating structure of the antenna. The fixed beam phased array of aperture coupled slots is optimized to receive a right hand polarized signal. The proposed antenna is made out of a single PCB board. The antenna has a very uniform phase and amplitude pattern in the azimuth plane from 1.15 to 1.65 GHz, therefore providing consistent performance at GPS, GLONASS, GALILEO and OmniSTAR® frequencies. The antenna also has a common phase center at the various frequencies from 1175 MHz to 1610 MHz and substantially the same radiation pattern and axial ratio characteristics.

20 Claims, 13 Drawing Sheets

LEAKY WAVE ANTENNA WITH RADIATING STRUCTURE INCLUDING FRACTAL LOOPS

BACKGROUND OF THE INVENTION

1. Field of the Invention

The present invention is related to planar spiral slot antennas and, more particularly, to such antennas having a wide bandwidth.

2. Background Information

Antenna design requirements differ depending upon the particular application of the antenna. Recently, there is a demand for antennas which have the capability of acquiring RF signals from various satellite ranging systems. For example, the satellite ranging systems include the United States Global Positioning System (GPS), the Russian Federation GLONASS System, the European GALILEO System, and commercial services such as the OmniSTAR® System, which provides GPS enhancement data via satellite.

The various satellite ranging systems use signals in different frequency bands, which range from 1175 MHz to 1610 MHz. Thus, a wide bandwidth is required for an antenna designed to receive signals from different ranging systems, and in particular for an antenna designed for use with all of the systems.

There are some known wide bandwidth antennas, however, these antennas tend to have a three dimensional architecture comprised of a stack of individual planar antennas or a complex patch antenna structure. In either case, the three dimensional nature of the design leads to a high profile antenna which is not suitable for aircraft or other applications in which a small form factor is a critical feature or a desirable feature.

In addition to a low profile physical structure, it is highly desirable that a multi-mode ranging application (i.e., GPS, GLONASS, GALILEO, OmniSTAR®-L5,) antenna have a common phase center for the incoming signals at the various frequencies (e.g., from 1175 MHz to 1610 MHz). This is important because the positioning measurements from the various ranging systems are calculated with reference to the phase center of the antenna. Although there are known processes for correcting phase center variation when the geometric phase center of an antenna and the electrical phase center of that antenna are misaligned, any such misalignment must be minimal for high accuracy multimode ranging applications. For example, in many applications, geodetic measurements must be accurate to the millimeter level. However, typically, a common phase center has not been provided even with an error within an acceptable tolerance range by the wide band, three-dimensional antenna structures discussed previously.

A commonly owned U.S. Pat. No. 6,452,560 issued on Sep. 17, 2002, to Kunysz for a SLOT ARRAY ANTENNA WITH REDUCED EDGE DIFFRACTION, which is incorporated herein by reference, describes a low profile slot array antenna in which the geometric and electrical phase centers are aligned. A conductive layer on the front antenna surface includes the array of slotted openings. When an electromagnetic signal is fed into one end of a transmission line and sequentially coupled into the slotted openings, a corresponding signal is emitted from the antenna substantially in the direction of the antenna axis. The front antenna surface also includes a surface wave suppression region enclosing the slotted array and a plurality of through openings disposed between the surface wave suppression region and the peripheral edge of the antenna to reduce defraction of the emitted signal at the peripheral edge. This antenna is particularly useful in the United States Global Positioning System as its slotted openings are tuned to receive both the L1 and L2 frequency bands. However, the antenna was not designed to receive a wider bandwidth including satellite ranging signals from the other systems previously mentioned.

It is also important in antenna design to provide an improved gain at low elevation signals, while still maintaining multi-path rejection. Reduced signal variation is also important in the azimuth plane at low elevation angles for L-band signals in the 1520 to 1560 MHz range.

It is thus an object of the invention to provide an antenna which has a wide bandwidth and a common phase center across the frequency band of interest. Additionally, it is an object of the invention to provide reduced signal variation in the azimuth plane and low gain at low elevation angles, and improved polarization purity.

Other objects of the invention will be apparent from the following detailed description.

SUMMARY OF THE INVENTION

The disadvantages of prior techniques are overcome by the present invention which is a wide bandwidth antenna that acquires RF signals from multiple satellite ranging systems including GPS, GLONASS, GALILEO and related commercial enhancement providers such as OmniSTAR®. The antenna of the present invention is a planar slot array antenna including a multi-arm radiating structure of interconnected slots, where each slot begins as a spiral and flares into a fractal loop configuration. A leaky wave microstrip multiple turn spiral feed network is used to excite the radiating structure of the antenna.

More specifically, the antenna is comprised of a non-conductive substantially planar printed circuit board ("PCB") substrate having an upper surface, which is metallized. The radiating structure is etched into the metallized upper surface of the substrate. As noted, the radiating structure is a network of interconnected slots that are shaped such that they begin as spiral slots and flare at their respective ends into fractal loop configurations. The fractal loop configuration at the end of each slot is coupled to the fractal loop configuration of an adjacent slot. This radiating structure of interconnected apertures create many RF paths, to open the bandwidth for wide bandwidth performance.

The flare of the slot arms also results in increased impedance at the end of the arm. By increasing the impedance at the end of the arm, a previous impedance discontinuity that may have existed is reduced in magnitude, leading to a smoother current distribution across the antenna. This continuously varying slot width and the interconnections between adjacent slot arms further smoothes out amplitude and phase patterns in the azimuth plane of the antenna. The radiating structure also provides a common phase center for the frequency bands of interest.

A microstrip multiple turn spiral transmission line is disposed on a lower surface of the substrate. The spiral shape of the transmission line improves the bandwidth performance of the antenna and improves the antenna efficiency in that the spiral feed microstrip crosses each slot twice thus allowing for the energy from each slot to be collected twice. In accordance with one aspect of the invention, the spiral feed microstrip is a two turn spiral. The spiral shape of the microstrip feeding transmission line has a larger bandwidth compared to circular feeding structures.

A shallow metallic ground plane is disposed adjacent to the lower surface of the substrate, which allows a relatively low profile structure. A second PCB board can be placed between the antenna substrate and the ground plane for additional RF absorption.

The antenna of the present invention may also include a surface wave suppression region which comprises an array of metallized openings along the peripheral edge of the antenna which causes diffraction of surface waves.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
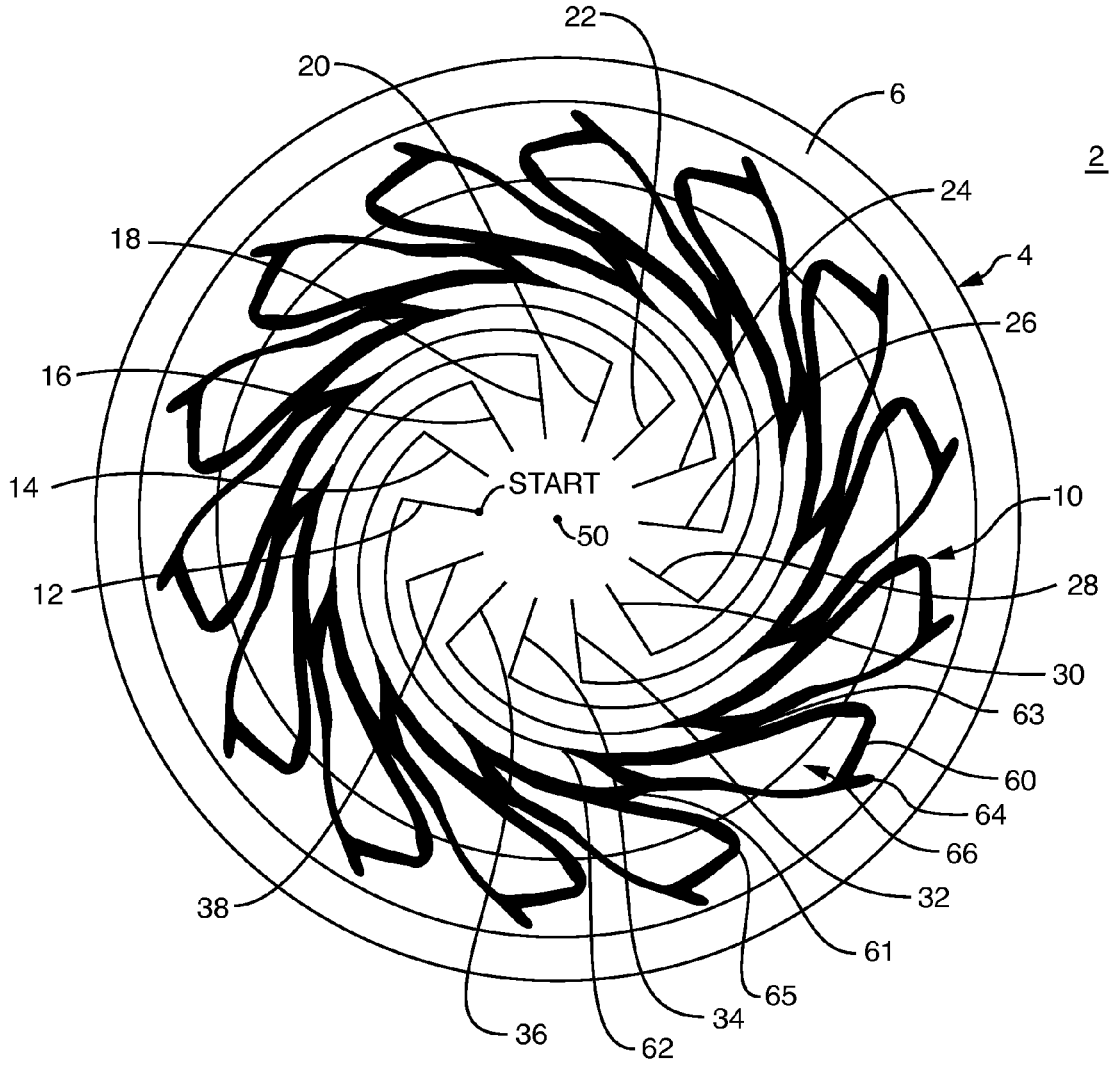
FIG. 1 is a diagrammatical view of the upper surface of an antenna in accordance with the present invention.

FIG. 1 is a diagrammatical view of the antenna 2 of the present invention illustrating the substrate 4 which is made of a PCB material. The upper surface 6 of the substrate 4 is metallized or plated. A radiating slot structure 10 is etched into the metallized upper surface 6, using standard PCB techniques. In accordance with the invention, the radiating slot structure 10 is a multi-armed aperture-coupled network with N spiral slot arms in a self-complementary structure, with each slot arm terminating in a fractal slot geometric shape. This creates a fixed beam phased array of aperture-coupled slots optimized to receive a right hand polarized signal.

More specifically, the radiating slot structure 10 includes a plurality of spiral slot arms 12 through 38. In the illustrative embodiment of FIG. 1, there are fourteen spiral slot arms. However, in other applications of the invention, the radiating slot structure may contain a different number of spiral slot arms or may contain apertures having different configurations and/or dimensions, as discussed further herein, while remaining within the scope of the present invention.

The spiral slot arms 12-38 are arrayed about an antenna phase center 50. Wherein the radiating slot structure is composed of N spiral slot arms, the spatial difference between each two consecutive spiral slot arms, for example, arms 12 and 14, is preferably $2\pi/N$, where N is the number of spiral slot arms.

The dimensions of the individual slot arms and the interconnections between adjacent arms are determined, in accordance with the invention, by the desired RF frequency band to be received by the antenna. As used herein, the term "frequency band(s) of interest" shall mean one or more of the frequency bands used by the various satellite ranging systems that are to be received by the antenna. These frequency bands include one or more of GPS, GLONASS, GALILEO and related commercial enhancement providers such as OmniSTAR®. If the frequency bands from all such systems are of interest, the overall band ranges from 1175 MHz to 1610 MHz. In addition, there may be other frequencies used outside of that range that can be received using an antenna constructed in accordance with the invention, with appropriate dimensions.

For the purpose of a complete description, a particular embodiment of the invention, with examples of the dimensions of the radiating slot structure 10, will be provided. It should be understood, however, that the description is provided for illustrative purposes only and is not limiting to the invention.

In the illustrative embodiment of FIG. 1, the radiating slot structure 10 has 14 spiral arms terminated into fractal loop configurations. In the illustrative embodiment of FIG. 1, the antenna 2 is intended to receive all of the frequencies of the various satellite ranging systems. These frequencies range from 1175 MHz to 1610 MHz.

More specifically, in this embodiment and application, the dimensions of the radiating slot structure are given with reference to slot 12 of FIG. 1, and the beginning of the measurement is taken from the beginning of the slot, which point is indicated in FIG. 1 by the arrow labeled "START." The spiral slot arm 12 begins as a flared spiral and then has a fractal loop configuration 60 at its distal end. The point where the fractal loop 60 begins is the same point at which the slot interconnects with the adjacent inner slot 38, which is designated by reference character 61. The distance from the start of the slot (START) to reference character 61 is, in accordance with the invention, one half wavelength ($\lambda/2$) of the OmniSTAR® frequency band of interest (which within the L-Band). The distance along the outer edge of the spiral slot arm 12 from the "START" point to where the fractal loop 60 begins, which is the same point slot 12 interconnects with the adjacent outer slot 14, is designated by reference character 62. This distance to reference character 62 is one quarter wavelength ($\lambda/4$) of the lowest frequency band of interest in the application, which in this example is L5, E5.

The distance along the spiral slot 12 from the START point to where the slot 12 forks into two arms, separating adjacent fractal loops is designated by reference character 63, and it is one half wavelength ($\lambda/2$) of the highest frequency band of interest, which in this example is Glonass L1 or "G1". The distance along the spiral slot 12 from the START point to where the left arm of the fork ends, which is called the "boot" herein is designated by reference character 64, and it is one half wavelength ($\lambda/2$) of the lowest frequency band of interest, which in this application is L5, E5.

The distance along the spiral slot 12 from the START point to where the right arm of the fork ends in the fractal loop 60 is designated by reference character 65, and this distance 65 is one half wavelength (λ/2) of the second lowest frequency band of interest (L2). The perimeter length around the fractal loop 60 is schematically indicated by the arrow associated with reference character 66. In the illustrative example, the perimeter 66 is one half wavelength (λ/2) of the mid-frequency of all frequency bands of interest, which in the illustrative embodiment is approximately 1.395 GHz. It is noted that in the illustrative example, the lowest frequency is 1.175 GHz (L5, E5) while the highest is G1 (1.61 GHz).

In accordance with the invention, the spiral slot arms also have a continuously varying width. In the illustrative embodiment, the width of the spiral slot 12 is 0.3 mm in the beginning at the START point, then the slot is continuously flared to about 2 mm at the fork junction (63).

As noted, the unique radiating slot structure 10 of the present invention, with its intercoupled apertures and fractal loop geometry opens the radiating bandwidth of the overall antenna 2 by providing multiple and varied RF paths for the incoming signals. Higher order fractal loops can be utilized in the radiating structure design under appropriate circumstances.

Figure 2:
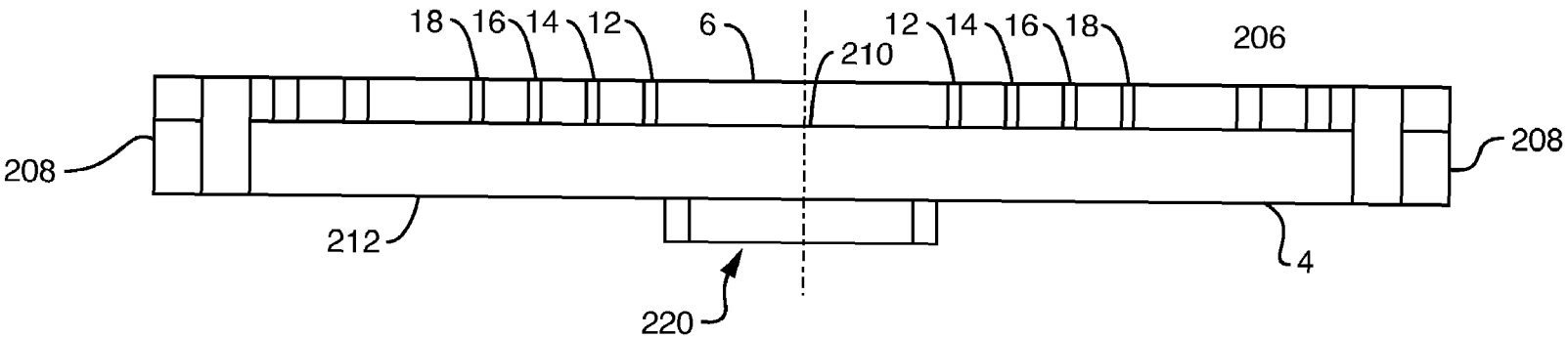
FIG. 2 is a cross-sectional view of the antenna of the present invention.

FIG. 2 is a cross-sectional view of the antenna 2 of the present invention, in which like components have the same reference characters as in FIG. 1. The antenna 2 comprises a substrate 4 of a dielectric or other non-conductive PCB material. As noted a metallized a conductive layer 206 is disposed on the upper surface 6 of the substrate 4. The upper surface 6 is bounded by a peripheral edge 208. As can be seen in cross section, each of the slotted openings 12-18 (the remaining slots are not shown for purposes of clarity of illustration) which slots are described in detail with reference to FIG. 1, extend from the upper surface 6 to a top aspect 210 of the substrate 4. The substrate 4 has a lower surface 212, on which a feeding network, generally designated with reference character 220, is disposed.

Figure 3A:
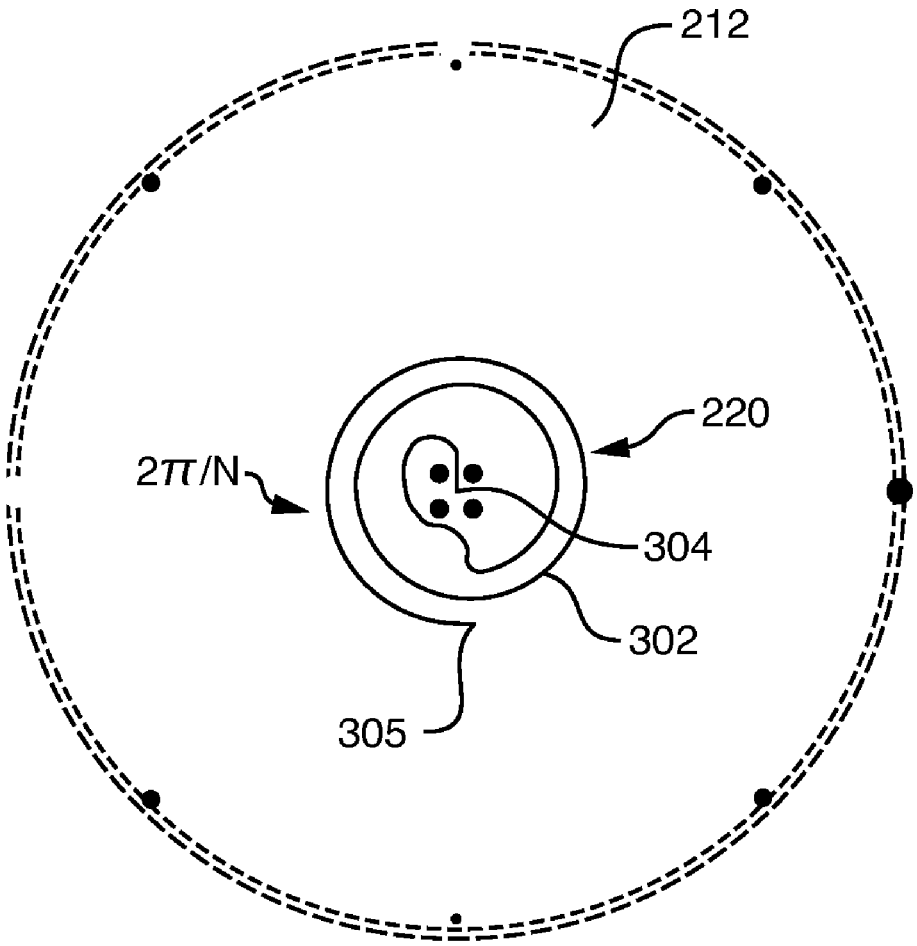
FIG. 3A is a diagrammatical view of the lower surface of the antenna illustrating the multiturn spiral microstrip feeding structure of the present invention.

Turning now to FIG. 3A, the feeding network 220 of the antenna is discussed in greater detail. In accordance with the invention, the feeding network 220 consists of a leaky wave spiral microstrip transmission line 302. The transmission line 302, which is disposed on the lower surface 212 of the substrate 4, is substantially spiral with an input end 304 for receiving electromagnetic signals and a terminal end 305 which may be electrically connected to a load impedance (not shown). The transmission line 302 couples electromagnetic energy between the transmission line 302 and the slotted arms 12-38.

The electrical phase length of the feeding network 220 is set to approximately 2π/N, where N is the number of spiral slot arms in the radiating slot structure of the antenna. The 2π/N approximation of the feed network is achieved by constructing a multi-turn spiral microstrip line 302 beneath the slots, to provide the required progression of the microstrip line electrical phase length between adjacent slots at a wide range of frequencies. A stable phase center and an excellent circular polarization over a wide frequency range are thus achieved using this feeding network 220. The feeding network 220 also maintains approximately uniform amplitude excitation for all slots.

Figure 3B:
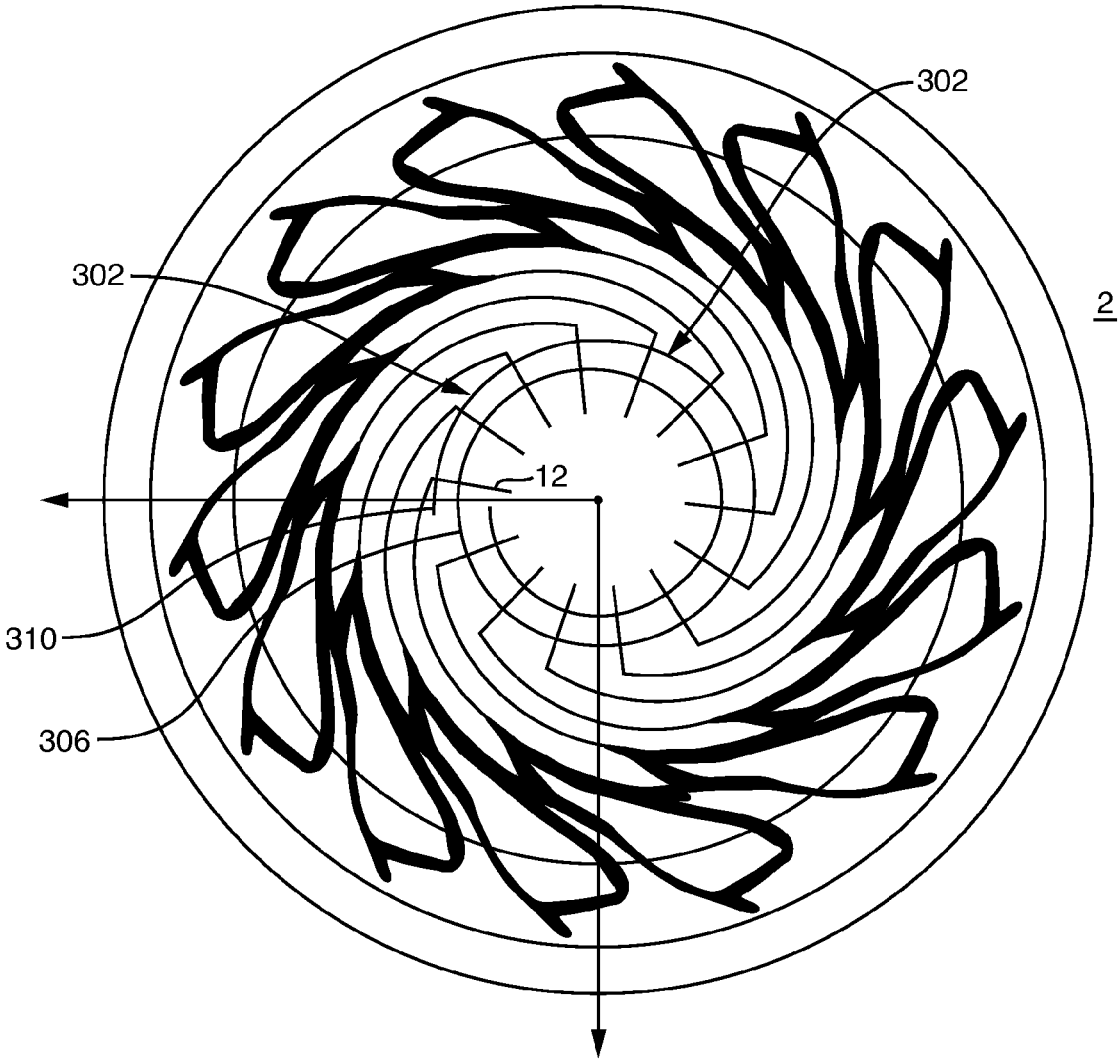
FIG. 3B is a diagrammatical view of the upper surface of the antenna of the present invention also depicting the microstrip feedline coupled with the slot arms of the radiating structure.

The interconnection between the feeding network and the radiating slot structure can be understood with reference to FIG. 3B in which the both slots 12-38 as well as the microstrip feed line 302 of the feeding network 220 are shown. It can be seen from FIG. 3B that the microstrip feed line 302 crosses each slot twice. For example, for the slot 12, the microstrip feed line crosses the slot 12 at region 306 and again at region 310. Accordingly, the electromagnetic coupling between the transmission line 302 and the slotted opening 12 occurs in two regions allowing for the information to be collected a second time which gives rise to a more accurate measurement.

Figure 4:
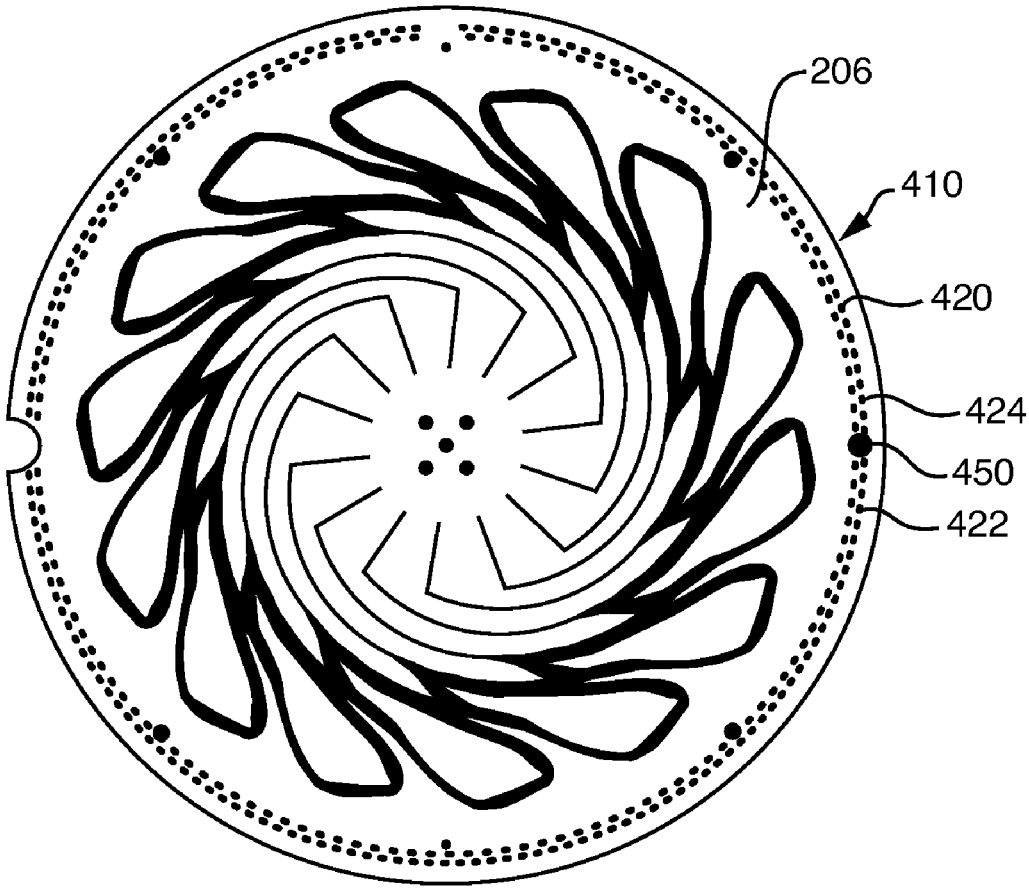
FIG. 4 is a simplified schematic view of the top layer of the antenna of FIG. 1 depicting the surface wave suppression region.

Turning to FIG. 4, the upper surface of an alternative antenna constructed in accordance with the present invention is shown in schematic form with the fourteen spiral slot arms, and a peripheral edge 410 that includes an optional surface wave suppression region 420, which comprises a photonic band gap (PBG) material disposed within the conductive metallized layer 206. The surface wave suppression 420 region comprises a plurality of openings 422-424 that are spaced such that there are a predetermined number of opening per unit wavelength. The openings are preferably spaced apart by less than 1/10λ to form a solid wall to diffract surface waves. These openings to do not affect the bandwidth of the antenna reception. The surface wave suppression features improve antenna performance particularly when a thick PCB substrate is being used. The larger openings 450 are used for securing or mounting the antenna 2 to the application device.

Figure 5:
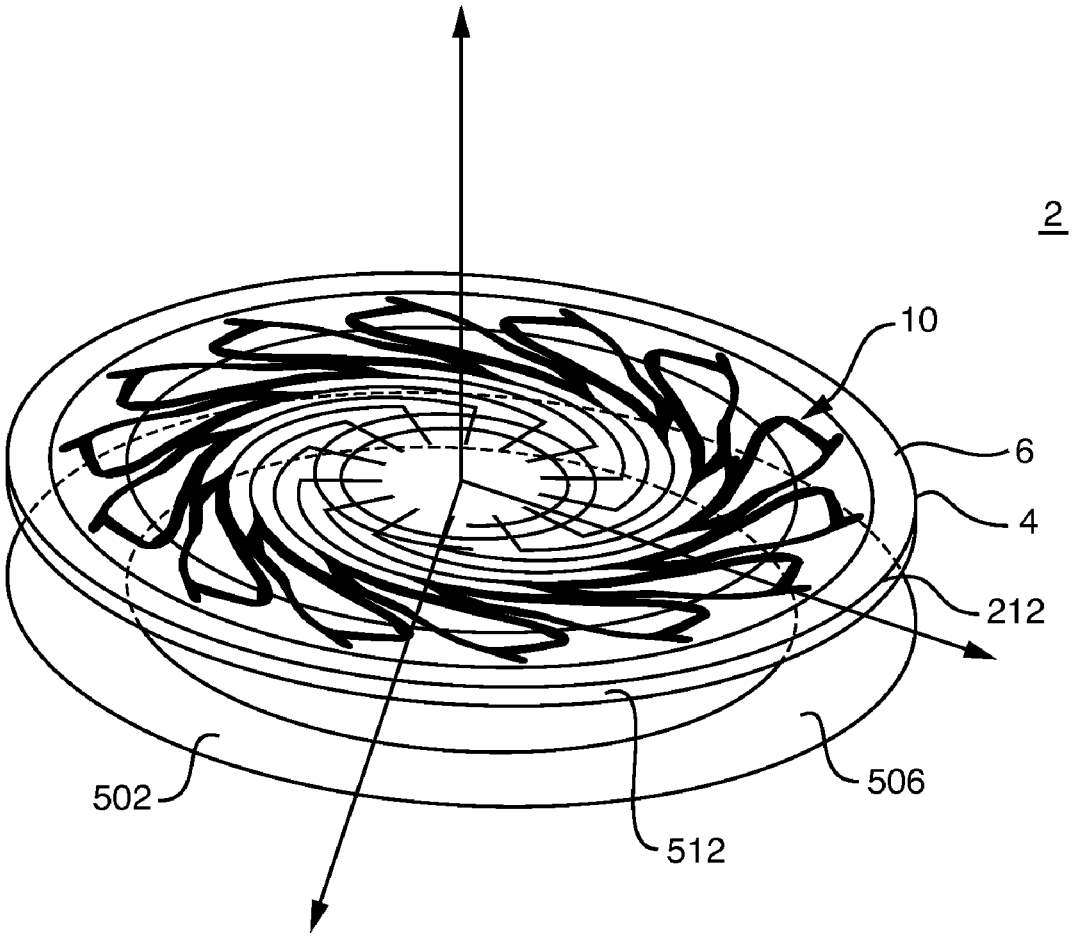
FIG. 5 is a side elevation of the antenna of the present invention in which the ground plane is visible.

FIG. 5 is a side elevation illustrating the antenna ground plane. As illustrated in FIG. 5, the antenna substrate 4 has the radiating slot structure 10 on an upper surface 6 thereof. The substrate 4 is backed by a shallow metallic ground plane 502, which is placed contiguous to the lower surface 212 of the substrate 4. A cavity 506 is formed between the ground plane 502 and the lower surface 212. The depth of the cavity 506 is 15 mm which translates from λ/16 to λ/12 over the frequency band of interest range. This allows a relatively low profile antenna compared to other cavity antenna using a standard λ/4 (quarter wavelength) cavity depth. A 10 mm thick RF foam absorber 512, which may be an additional PCB layer, can be placed between the substrate 4 and the ground plane 502 to resist leakage of cross-polarized signals from the antenna 2.

The antenna 2 of the present invention including the ground plane 502 is lightweight in that it weighs approximately 0.45 kilograms (kg) and is small with a diameter of 5.5 inches.

Figure 6:
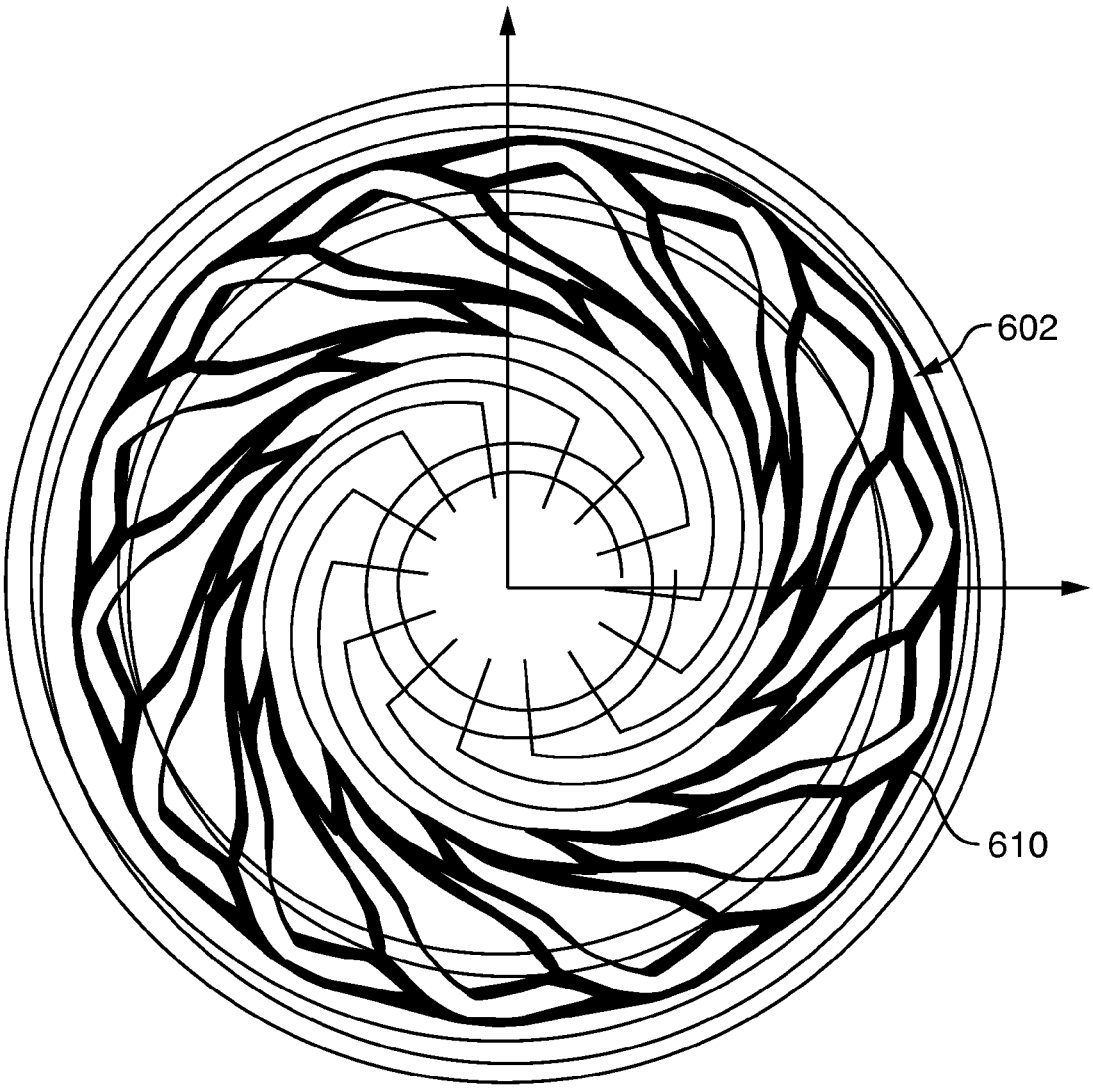
FIG. 6 is an alternative embodiment of the invention showing an alternative radiating structure.
Figure 7:
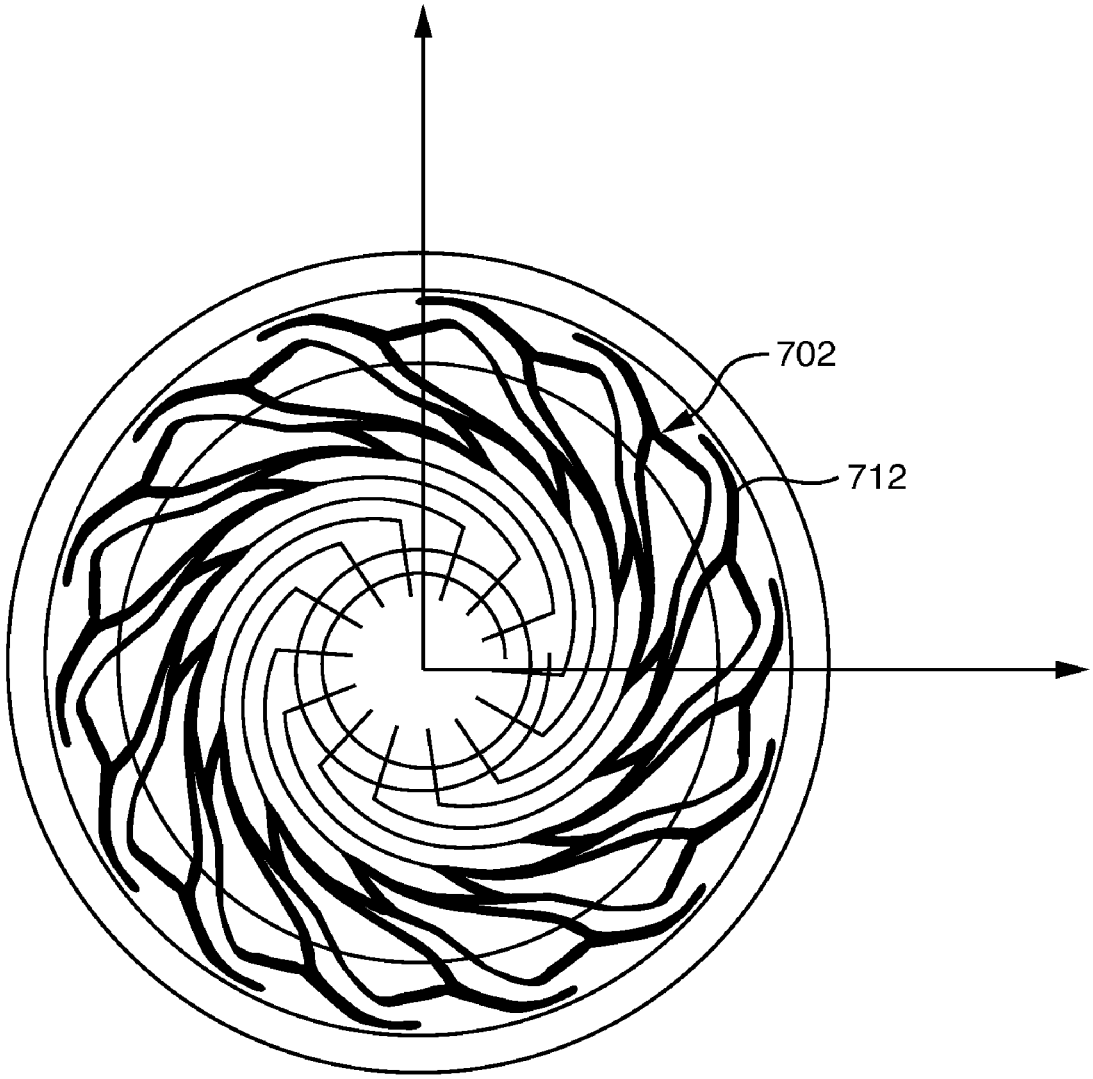
FIG. 7 is another embodiment of the invention showing yet an alternative radiating structure.

Alternative radiating slot structures are illustrated in FIGS. 6 and 7. As illustrated in FIG. 6, the radiating slot structure 602 is comprised of N spiral arms which are terminated in fractal loops that interconnect to form an outer ring 610.

FIG. 7 illustrates another variant in which the antenna radiating slot structure 702 includes spiral arms terminated in fractal loops, but which have longer tails 712 at the ends thereof.

These alternative embodiments of FIGS. 6 and 7 are used in other applications in which an increased gain at a lower frequency is desired, but this is at the cost of a reduced gain at the higher frequencies. Thus, the design of the radiating slot structure will be selected, depending upon the parameters and specifications needed for the particular application of the invention.

SIMULATION AND TEST RESULTS

The antenna design of the present invention was tested performing detailed electromagnetic simulations using a high frequency structure simulation ("HFSS".) The measured phase center location for various GNSS bands is illustrated in Table 1. Table 1 shows that it is possible to have a single antenna element with phase center variation not exceeding 2 mm with all bands of interest. Therefore, ranging error introduced by the antenna is minimal when using a combination of GPS, GLONASS and GALILEO positioning satellite systems.

TABLE 1

Measured Phase Center Location for various GNSS bands

| Constellation & Signal Type | Vertical Phase Center (mm) Max. | Vertical Phase Center (mm) Ave. | Horizontal Phase Center (mm) Max. | Horizontal Phase Center (mm) Ave. |
|---|---|---|---|---|
| GPS L5/Galileo E5a | 1.2 | 0.7 | 1.0 | 0.7 |
| Galileo E5b | 1.3 | 0.8 | 1.1 | 0.7 |
| GPS L2 | 1.5 | 0.8 | 1.2 | 0.8 |
| Glonass L2 | 1.8 | 1.2 | 1.5 | 1.1 |
| Omnistar L-Band | 0.4 | −0.1 | 1.0 | 0.8 |
| Galileo E1 | 0.4 | 0.0 | 0.9 | 0.7 |
| GPS L1 | 0.5 | 0.0 | 0.8 | 0.6 |
| Galileo E2 | 0.6 | 0.3 | 0.8 | 0.6 |
| Glonass - L1 | 0.7 | 0.4 | 1.2 | 0.7 |

Figure 8:
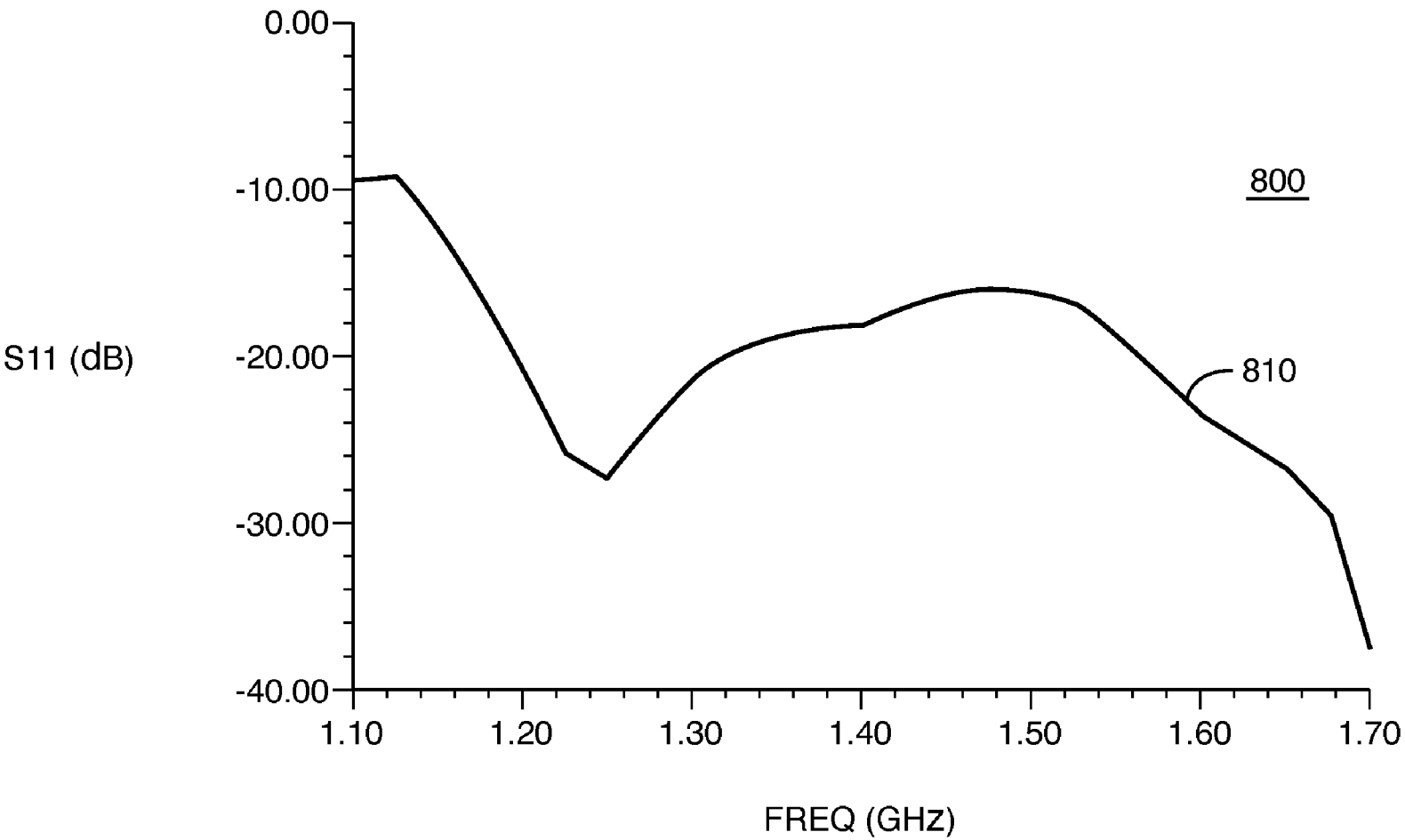
FIG. 8 is a graph of Return Loss for the antenna of the present invention with S11 in decibels on the ordinate versus frequency on the abscissa.

The performance of the antenna of the present invention was tested by conducting electromagnetic simulations using HFSS. An excellent performance for antenna return loss is illustrated in FIG. 8 which is a plot 800 of frequency in gigahertz (GHz) on the abscissa against simulated reflection coefficient values (known as "S11") in decibels (dB) on the ordinate. The curve 810 illustrates the return loops over the frequency range of interest.

Figure 9:
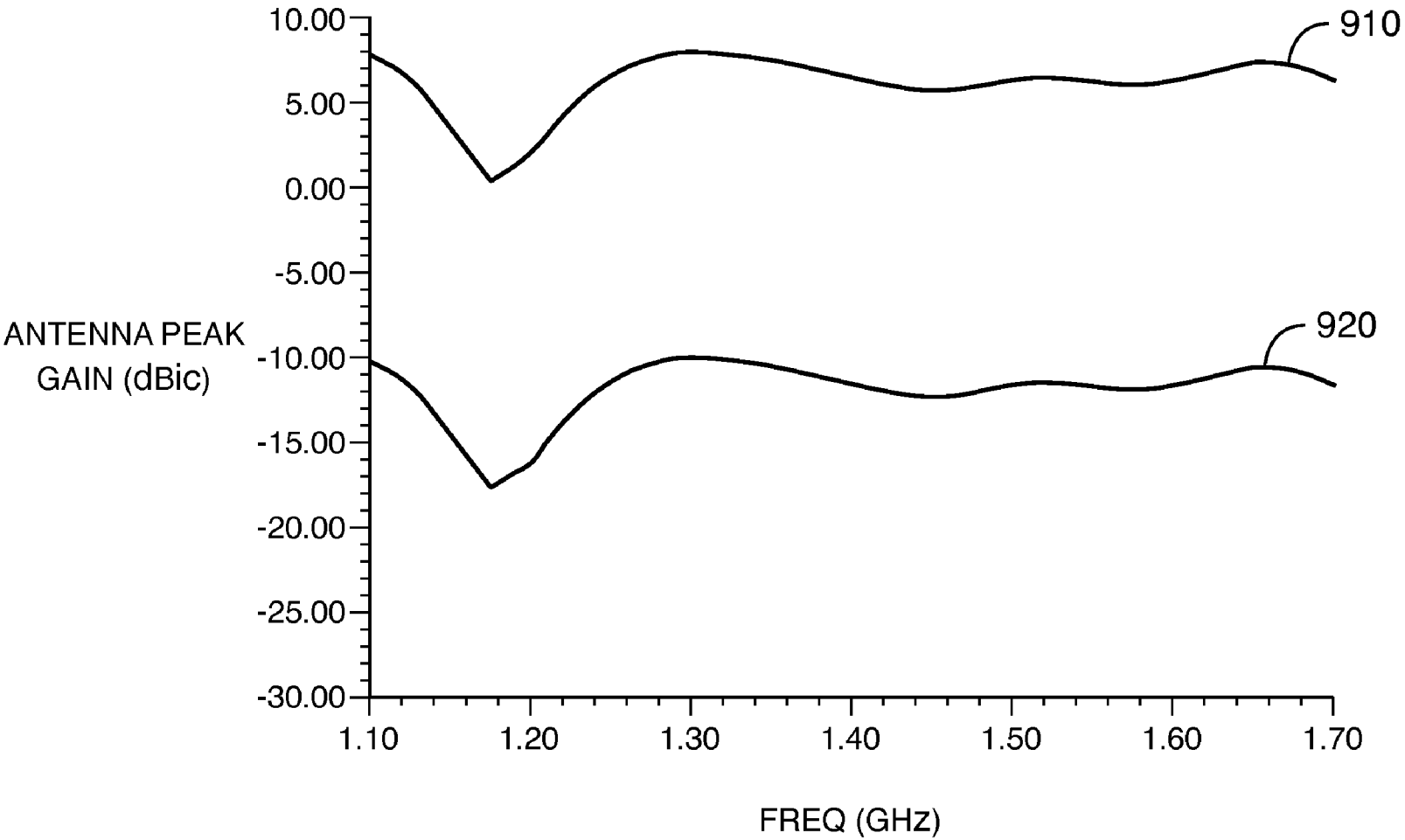
FIG. 9 is a graph of antenna peak gain over frequency for a right hand circularly polarized signal and a left hand circularly polarized signal for the antenna of the present invention.

The antenna peak gain was simulated as illustrated in FIG. 9. FIG. 9 is a plot of frequency in GHz against antenna peak gain (boresight) in dB/c. The curve 910 illustrates the right hand circularly polarized (RHCP) peak gain for the antenna, and the curve 920 illustrates the left hand circularly polarized (LHCP) peak gain for the antenna.

Figure 10A:
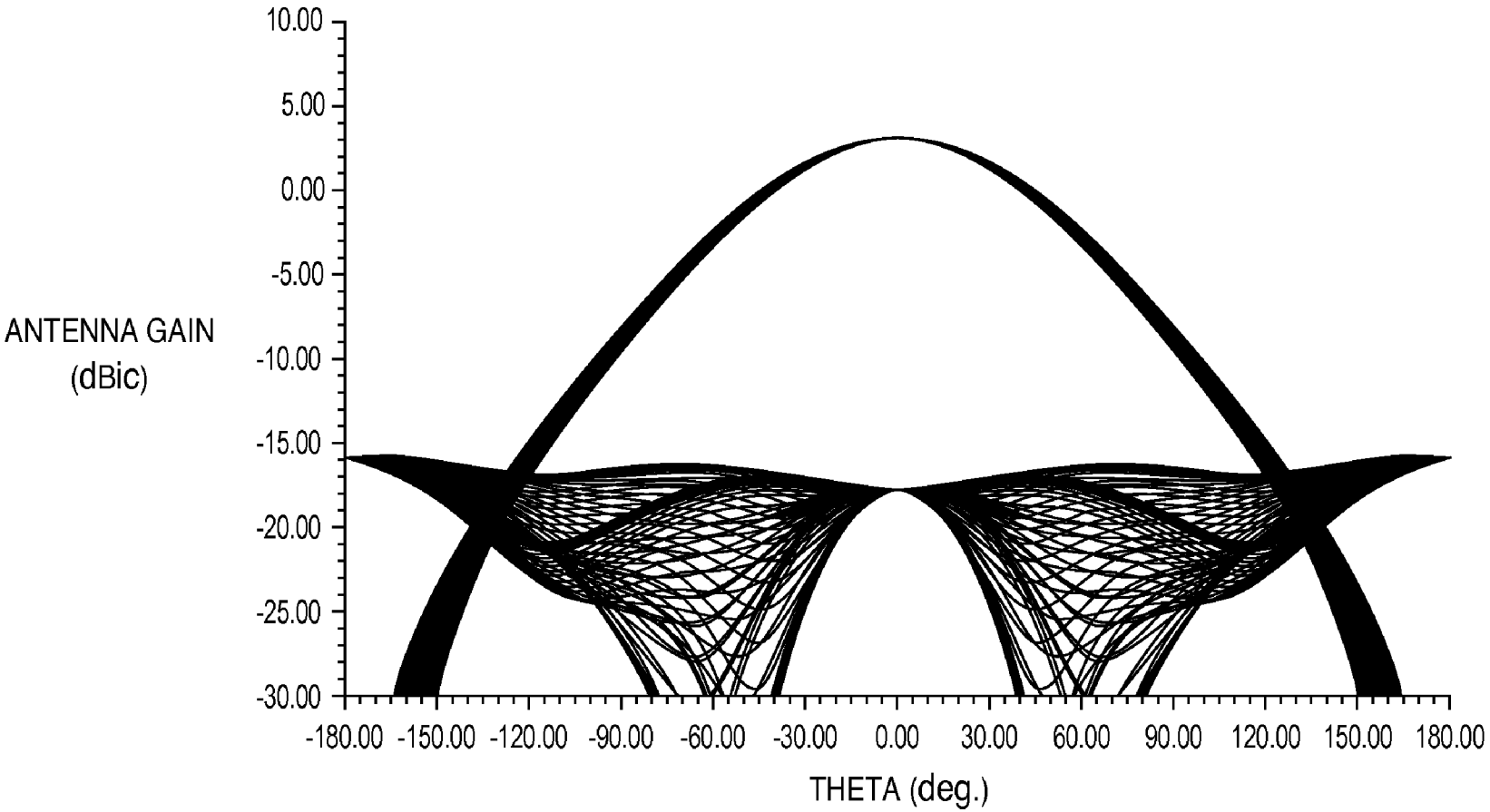
FIG. 10A is a simulated radiation pattern for the antenna of the present invention at 1227.6 MHz.
Figure 10B:
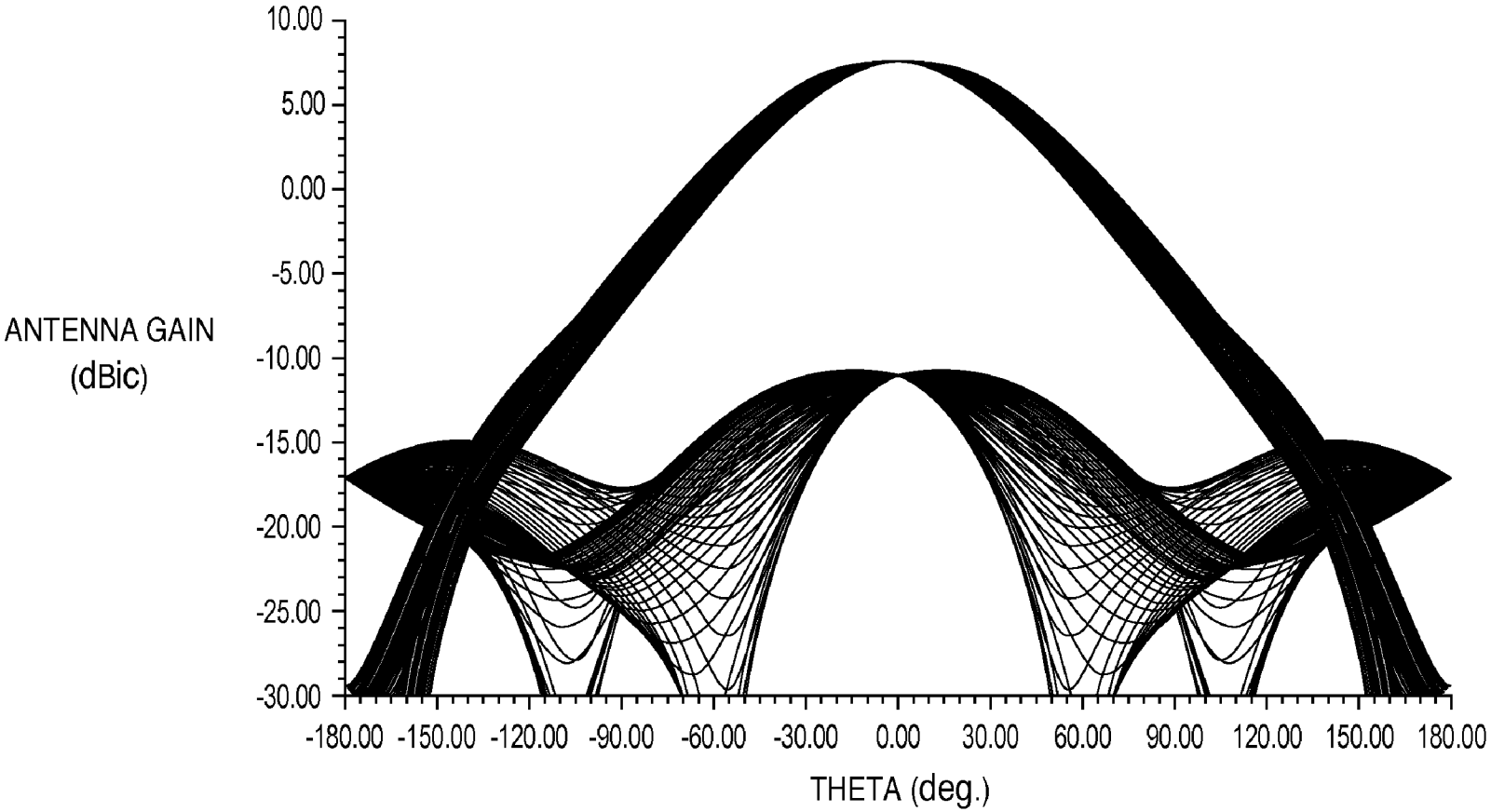
FIG. 10B is a simulated radiation pattern for the antenna of the present invention at 1575.4 MHz.

A vertical radiation pattern is illustrated in FIG. 10A for a simulation at a frequency of 1227.6 MHz. A vertical radiation pattern for a simulation of the antenna at the frequency of 1575.4 MHz is illustrated in FIG. 10B. The symmetry of the radiation pattern at each frequency is apparent in each plot.

Figure 11:
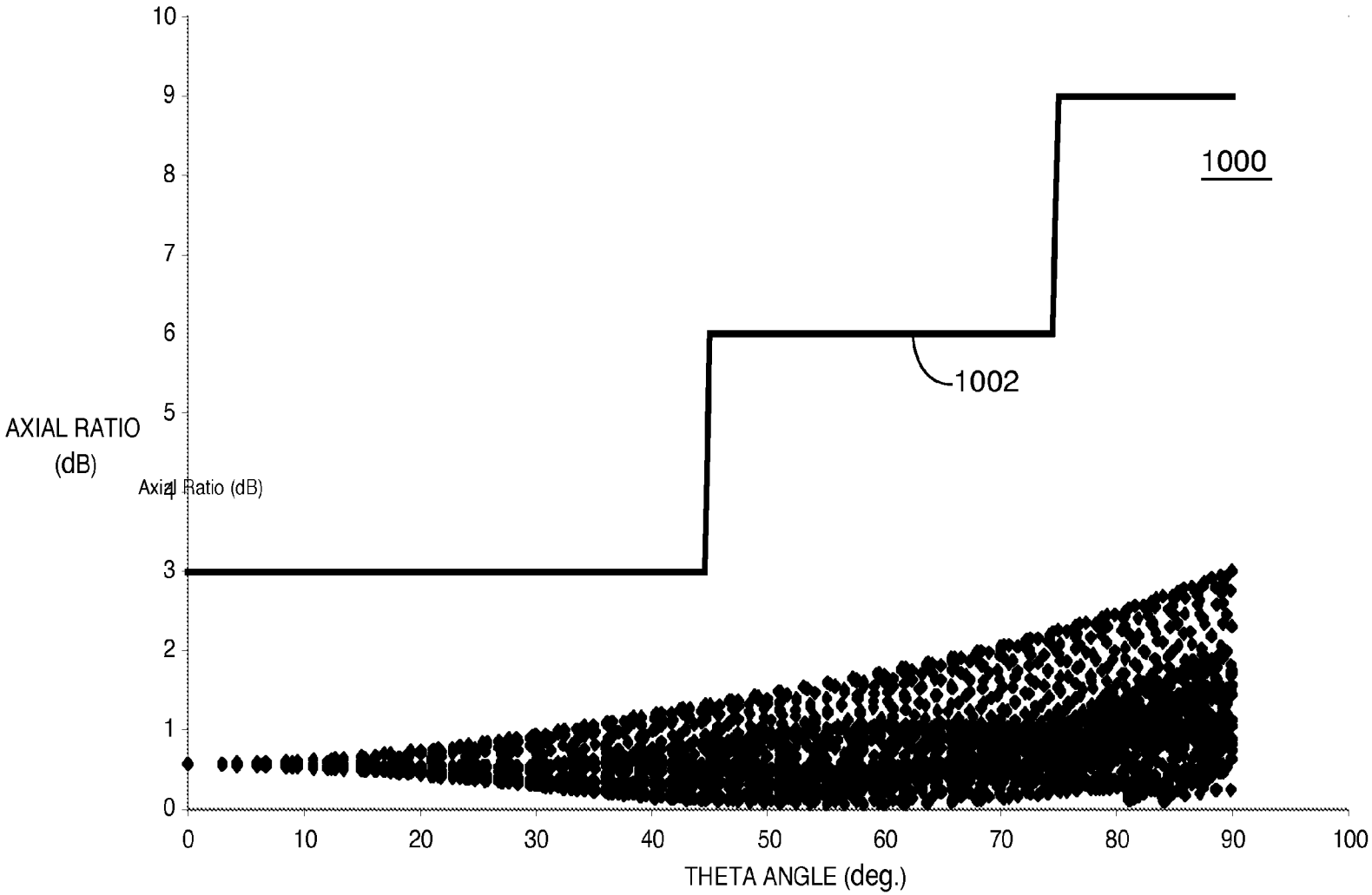
FIG. 11 is a measured axial ratio pattern at 1575.4 MHz for the antenna of the present invention.

The antenna of the present invention was also tested by performing anechoic chamber measurements. The anechoic chamber measurements were used to determine the radiation pattern characteristics and phase center variation over all frequency bands of interest. FIG. 11 illustrates the Axial Ratio of the antenna.

The tests and simulations illustrate that the antenna of the present invention has excellent performance in the areas of antenna return loss, gain, Axial Ratio, Front-Back Ratio and amplitude variation in the azimuth plane over the range of frequency bands of interest. The antenna provides a consistent performance over the frequency band of interest.

The antenna of the present invention is advantageous for precise positioning applications. The antenna has multi-frequency performance guaranteeing uniform performance results across all frequency bands. The low profile of the antenna makes it suitable for applications such as vehicle, aircraft, missile, rocket, and many other high impact applications. The stable phase center and uniform phase radiation pattern across all frequencies of interest of the antenna provides for real-time kinematic positioning applications. Axial ratio and front-back ratio provides good performance in high multi-path environments. The antenna is simple to manufacture and can easily meet harsh environmental requirements making it suitable for marine and arctic applications.

What is claimed is:

1. An antenna, suitable for receiving multiple electromagnetic signals in a frequency band of interest, each signal being of its own respective wavelength λ, said antenna comprising:

a non-conductive, substantially planar substrate having an upper surface and a lower surface;

a conductive metallized layer disposed on said upper surface, said conductive metallized layer having a radiating slot structure etched therein, said radiating slot structure including a plurality of interconnected spiral slot arms, each slot arm being terminated in a fractal loop configuration;

a multi-turn spiral transmission line disposed on the lower surface of said substrate; and a metallized ground plane adjacent to the lower surface of said substrate forming a cavity between the substrate and the ground plane.

2. The antenna as defined in claim 1, wherein each fractal loop configuration is interconnected with at least one adjacent fractal loop configuration of an adjacent slot arm.

3. The antenna as defined in claim 2 wherein each said fractal loop configuration also includes a tail portion extending beyond said fractal loop configuration towards a peripheral edge of said antenna.

4. The antenna as defined in claim 1 wherein the spatial difference between each two consecutive spiral slot arms is $2\pi/N$ where N is the number of spiral slot arms.

5. The antenna as defined in claim 1 wherein each slot arm has an inner edge and an outer edge, with the width of the slot arm being defined as the distance between the inner edge and the outer edge, and wherein each slot arm has a first width at a first end which is nearest an antenna center point, and said width is flared to a larger dimension at the point where its fractal loop configuration begins.

6. The antenna as defined in claim 5, wherein the distance along an inner edge of each slot arm from the beginning of the slot arm to a point to where the fractal loop configuration begins is about one half wavelength (λ/2) of an OmniSTAR® frequency band of interest in the L-Band.

7. The antenna as defined in claim 5, wherein the distance along the outer edge of the slot arm from the beginning of the slot arm to where the fractal loop configuration begins is the point at which the slot arm interconnects with an adjacent outer slot.

8. The antenna as defined in claim 7 wherein the distance along the outer edge of the slot arm from the beginning of the slot arm to where the fractal loop configuration begins is about one quarter wavelength (λ/4) of the lowest frequency band of interest.

9. The antenna as defined in claim 5 wherein each slot arm forks into two arms, separating adjacent fractal loops.

10. The antenna as defined in claim 9 wherein the distance along the slot arm from the beginning of the slot arm to where the slot arm forks into two arms, separating adjacent fractal loops, is about one half wavelength (λ/2) of the highest frequency band of interest.

11. The antenna as defined in claim 3 wherein the distance along the slot arm from the beginning of the slot arm to a tail end is about one half wavelength (λ/2) of the lowest frequency band of interest.

12. The antenna as defined in claim 5 wherein the distance along the slot arm from the beginning of the slot arm to where a right arm of a fork in the fractal loop ends, is about one half wavelength ($\lambda/2$) of the second lowest frequency band of interest.

13. The antenna as defined in claim 1 wherein the perimeter around the fractal loop configuration is about one half wavelength of the mid-frequency of all frequency bands of interest.

14. The antenna as defined in claim 1 wherein the electrical phase length of the transmission line is set to $2\pi/N$.

15. The antenna as defined in claim 1 wherein the spiral transmission line is a two turn spiral.

16. The antenna as defined in claim 1 having a wide bandwidth ranging from at least about 1175 MHz to 1610 MHz.

17. The antenna as defined in claim 1 wherein the antenna is adapted to receive signals from one or more of the GPS, GLONASS, GALILEO and OmniSTAR® systems.

18. The antenna as defined in claim 1 further comprising an RF absorber disposed between the lower surface of said substrate and the ground plane.

19. The antenna as defined in claim 18 wherein said RF absorber is a circular component substantially comprised of a PCB material.

20. The antenna as defined in claim 1 wherein a peripheral edge of said antenna includes a surface wave suppression region.

* * * * *